US006346008B1

(12) United States Patent
Hacker

(10) Patent No.: US 6,346,008 B1
(45) Date of Patent: Feb. 12, 2002

(54) PHONO-TYPE PLUG WITH AN INSULATING ELEMENT HAVING A STRAIN RELIEF EXTENSION FOR SUPPORTING A WIRE

(76) Inventor: Jed Hacker, 2336 E. 26th St., Brooklyn, NY (US) 11229

( * ) Notice: Subject to any disclaimer, the term of this patent is extended or adjusted under 35 U.S.C. 154(b) by 0 days.

(21) Appl. No.: 09/760,424

(22) Filed: Jan. 11, 2001

(51) Int. Cl.[7] ..... H01R 9/05
(52) U.S. Cl. ..... 439/578; 439/460; 439/675
(58) Field of Search ..... 439/578, 675, 439/449, 452, 459, 460, 457, 874

(56) References Cited

U.S. PATENT DOCUMENTS 4,129,352 A * 12/1978 Iizuka ..... 439/675
4,138,188 A * 2/1979 Shannon ..... 439/578
4,270,832 A * 6/1981 Tanabe ..... 439/457
5,021,010 A * 6/1991 Wright ..... 439/578
5,474,476 A * 12/1995 Cheng ..... 439/675

FOREIGN PATENT DOCUMENTS

JP 1-265470 * 10/1989 ..... 439/578
JP 4-329276 * 11/1992 ..... 439/578

* cited by examiner

*Primary Examiner*—Tho D. Ta
(74) *Attorney, Agent, or Firm*—I. Zborovsky; G. Cohen

(57) ABSTRACT

A phono-type plug has a center pin, a ground element, a barrel surrounding the ground element and the center pin, and an insulating element provided between the pin and the barrel, the insulating elements being provided with an extension which forms a strain relief supporting a wire.

9 Claims, 2 Drawing Sheets

PHONO-TYPE PLUG WITH AN INSULATING ELEMENT HAVING A STRAIN RELIEF EXTENSION FOR SUPPORTING A WIRE

BACKGROUND OF THE INVENTION

The present invention relates generally to phono-type plugs, in particular such as plugs for stereophonic equipment, amplifiers, video and any electrical apparatus requiring a single-ended, unbalanced plug.

Plugs of the above mentioned general type are known in the art. One of such plugs shown in FIG. 1 has a positive center pin, a ground element and a barrel. Another plug shown in FIG. 2 has a metallic barrel, and two internal elements: the solder point for the positive center pin which is an extension for the center pin, and a ground strain relief piece which is an extension from the ground and is a solder point for the ground. Its main additional function is to hold the wire in place inside the plug. FIG. 3 shows a further plug which is provided with an insulation. Still another plug is shown in FIG. 4. It includes a plastic barrel that is not screwable, in which there is no ground extension piece. The wire is soldered to the ground per se near the front end of the plug. The support to the wire inside the plug, i.e. the strain relief, is provided by the entire barrel itself. There is no ground strain relief piece. It is believed that the existing plugs can be further improved.

SUMMARY OF THE INVENTION

Accordingly, it is an object of the present invention to provide a phono-type plug which is a further improvement of the existing plugs.

In keeping with these objects and with others which will become apparent hereinafter, one feature of present invention resides, briefly stated, in a phenotype plug which has a barrel; a center pin; a ground element, an insulating element located between said barrel and said pin and having an extension adapted to support a wire and to provide a strain relief.

When the plug is designed in accordance with the present invention, the strain relief element is no longer composed of metal and therefore an unnecessary metallic component is eliminated, resulting in less attenuation of the signal, also known as less reflection. The plug is also less expensive to manufacture. Also, a higher quality of insulation is provided.

In accordance with an additional feature of the present invention the barrel can be also composed of a non-metallic material, which additionally enhances the above mentioned advantages. The quantity of the metallic material is further reduced, resulting in additional reduction of attenuation or reflection, the cost to manufacture is further reduced, and the quality of the insulation is increased.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
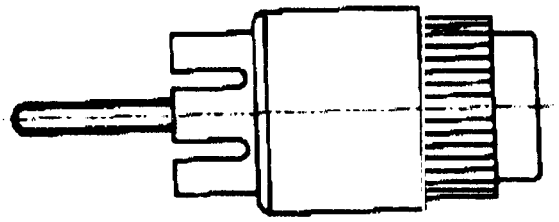
FIG. 1 PRIOR ART
FIGS. 1–4 are views showing phono-type plugs in accordance with the prior art.
Figure 2:
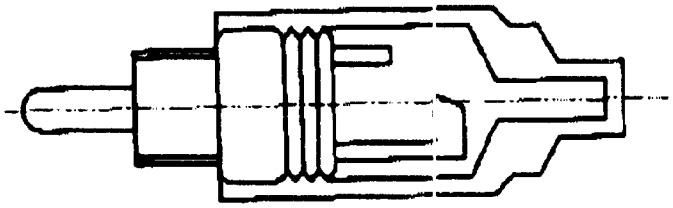
FIG. 2 PRIOR ART
Figure 3:
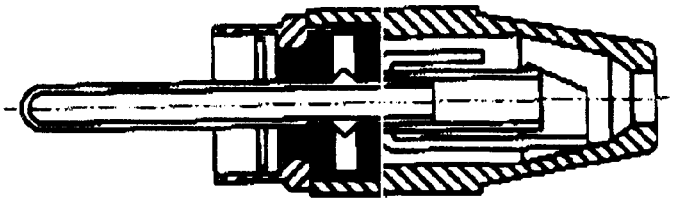
FIG. 3 PRIOR ART
Figure 4:
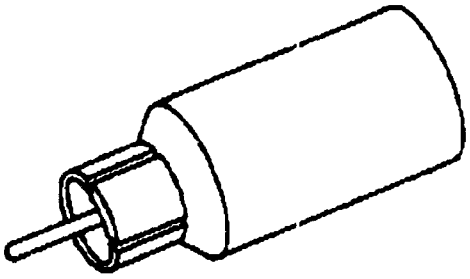
FIG. 4 PRIOR ART

A phonotype plug in accordance with the present invention has a positive center pin which is identified with reference numeral 1. A ground element is identified with reference numeral 2. The plug further has a barrel which is identified as a whole with reference numeral 3. In accordance with the present invention the barrel is composed of a non-metallic material, for example plastic or polyglass. A body 4 is inserted in the barrel 3, for example screwed in the latter.

The plug further has an insulation which includes an insulating disk 5. It is located between the pin 1 on the one hand, and the body 4 and the ground 2 on the other hand. The insulating disk 5 is provided with a narrow extension which is identified with reference numeral 6 and extends into an inner space inside a rear part of the barrel 1 without contacting the barrel. The extension 6 is elongated and solid rod-shaped. The extension 6 forms an insulation strain relief in that it holds a wire. The insulating disk 5 with the extension 6 is composed of an insulating material. The wire is unraveled, and its one part contacts with the pin 1 and the other part contacts with the ground element 2.

Figure 5:
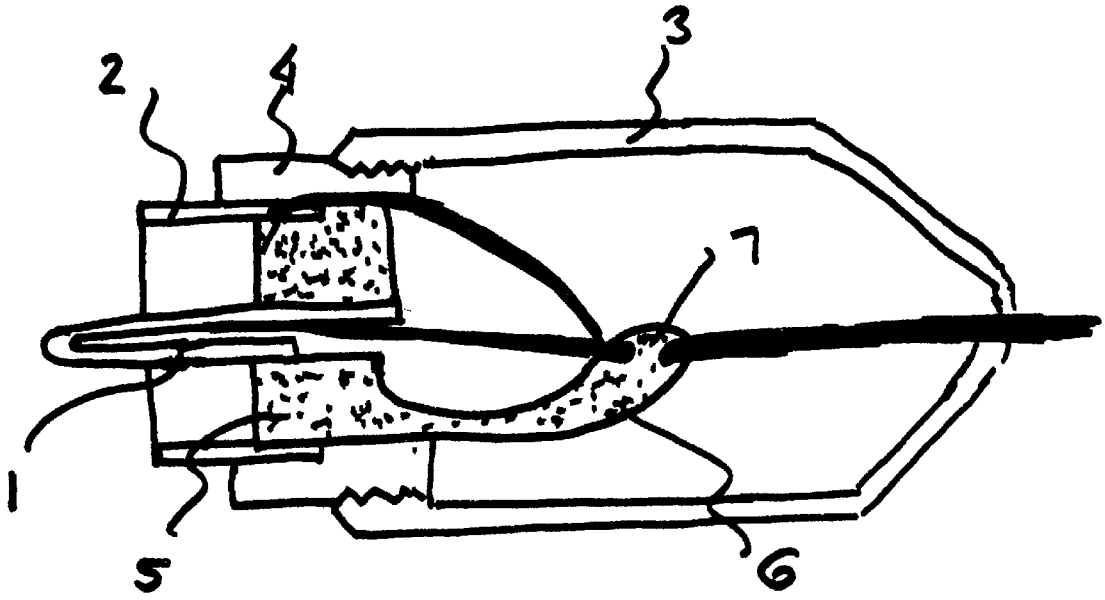
FIG. 5 is a view showing a phono-type plug in accordance with the present invention.

In order to connect the wire, the extension 6 can be provided with connecting means. In the embodiment shown in FIG. 5 the connecting means is formed as two holes provided at a distal end of the extension 6 and forming a two-hole slip joint 7. The wire can be connected with the extension piece 6 through the slip joint as shown in FIG. 5.

Figure 6:
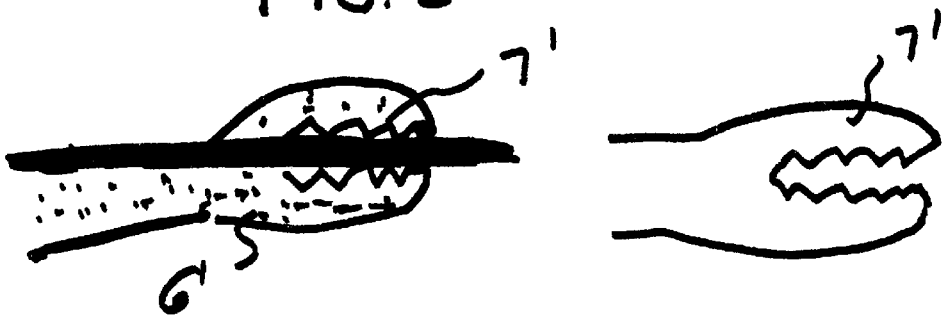
FIGS. 6 and 7 are views showing additional modifications of the inventive plug.

FIG. 6 shows another embodiment of the present invention. Here the extension piece 6' has teeth 7' which replace the two-hole slip joint and used for the same purpose, in particular for supporting the wire. Toothed portions of this extension piece are compressed to hold the wire.

Figure 7:
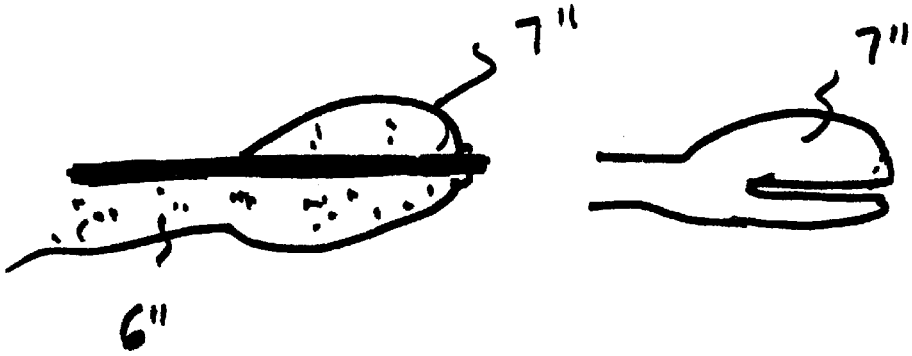

Finally, in the embodiment shown in FIG. 7, the distal end of the extension 6" has a clamp 7" for connecting the wire to the extension piece 6. The clamp portions are also compressed to hold the wire.

As can be seen from the drawings, the extension piece 6 is formed of one-piece with the disk 5 as an integral, one-piece element.

It will be understood that each of the elements described above, or two or more together, may also find a useful application in other types of constructions differing from the types described above.

While the invention has been illustrated and described as embodied in phono-type plug, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. A phono-type plug, comprising a center pin; a ground element; a barrel surrounding the ground element and said center pin; an insulating element provided between said pin and said barrel; and an insulating narrow extension which forms a strain relief for supporting a wire, said extension extending from said insulating element into an inner space of said barrel without contacting said barrel.

2. A phono-type plug as defined in claim 1, wherein said insulating element and said extension are formed of insulating material and as a one-piece element.

3. A phono-type plug as defined in claim 1, wherein said barrel is composed of a non-metallic material.

4. A phono-type plug as defined in claim 1, wherein said non-metallic material is a material selected from the group consisting of plastic and polyglass.

5. A phono-type plug as defined in claim 3, wherein said connecting means of said extension includes a toothed connection for connecting the wire to said extension.

6. A phonotype plug as defined in claim 5, wherein said connecting means of said extension includes a two-hole slip joint.

7. A phono-type plug as defined in claim 3, wherein said connecting means of said extension includes a toothed connection for connecting the wire to said extension.

8. A phonotype plug as defined in claim 5, wherein said connecting means of said extension includes a clamp for connecting said wire to said extension.

9. A phono-type plug, comprising a center pin; a ground element; a barrel surrounding the ground element and said center pin; and an insulating element provided between said pin and said barrel, said insulating element being provided with a narrow extension which forms a strain relief for supporting a wire, said extension extending into an inner space of said barrel without contacting said barrel, said extension being formed as a solid, elongated rod-shaped element.

* * * * *